US007217330B2

(12) United States Patent
Thamboo et al.

(10) Patent No.: US 7,217,330 B2
(45) Date of Patent: May 15, 2007

(54) TURBINE ROTOR HEAT TREATMENT PROCESS

(75) Inventors: Samuel Vinod Thamboo, Latham, NY (US); Michael Francis Henry, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 398 days.

(21) Appl. No.: 10/604,633

(22) Filed: Aug. 6, 2003

(65) Prior Publication Data

US 2007/0034306 A1 Feb. 15, 2007

(51) Int. Cl.
*C22F 1/10* (2006.01)

(52) U.S. Cl. ..... 148/675; 148/676; 148/677

(58) Field of Classification Search ..... None
See application file for complete search history.

(56) References Cited

U.S. PATENT DOCUMENTS 3,220,829 A * 11/1965 Bieber et al. ..... 420/454
3,871,928 A * 3/1975 Smith et al. ..... 148/607
4,985,201 A 1/1991 Chang et al.
5,019,334 A 5/1991 Jackson
5,080,734 A 1/1992 Krueger et al.
5,100,050 A 3/1992 Krueger et al.
5,161,950 A 11/1992 Krueger et al.
5,415,712 A 5/1995 Thamboo
5,820,817 A 10/1998 Angeliu et al.
6,128,820 A 10/2000 Nolan et al.
6,217,286 B1 4/2001 Huang et al.
6,447,624 B2 * 9/2002 Nonomura et al. ..... 148/677
6,454,531 B1 9/2002 Crawmer
6,494,683 B1 12/2002 Nolan et al.

* cited by examiner

*Primary Examiner*—John P. Sheehan
(74) *Attorney, Agent, or Firm*—Nixon & Vanderhye P.C.

(57) ABSTRACT

A method of heat treating a turbine rotor disk to obtain different radial properties at different locations in the rotor disk includes a) heating the rotor disk for a period of from 4 to 10 hours at a temperature of 1800° F.; b) cooling the rotor disk to a temperature of about 1550° F.; c) holding the rotor disk at about 1550° F. for a period of from about 2 to about 4 hours; d) cooling the rotor disk to room temperature; e) precipitation aging the rotor disk by heating the rotor disk to temperature of 1325° F. for 8 hours, holding it at 1150° F. for 8 hours, and f) cooling the rotor disk.

5 Claims, 1 Drawing Sheet

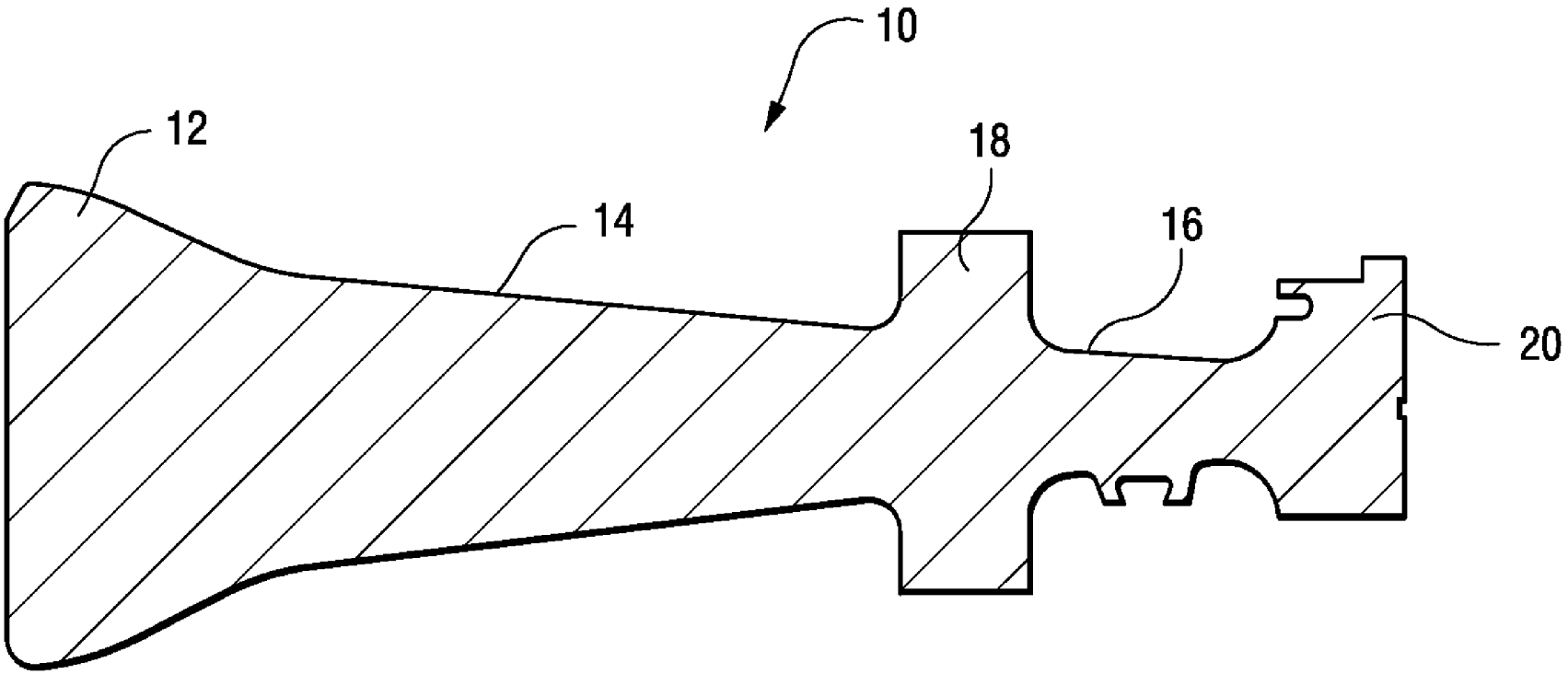
10
12
14
16
18
20

TURBINE ROTOR HEAT TREATMENT PROCESS

BACKGROUND OF INVENTION

This invention relates to heat treatment of turbine components and specifically, to a heat treatment schedule for achieving different properties at different locations in a nickel base superalloy turbine rotor disk.

Generally, it is known that differential heat treatment of an object can be employed to impart different properties at different locations. However, while such treatment works well on cylindrical objects, it is difficult to implement on more complex shapes such as found in turbine wheels or disks.

Alloy 706 is a nickel-based superalloy used for high temperature applications in gas turbines. This alloy can be used in connection with two heat treatment conditions identified by the inventor of the alloy (International Nickel Company) in the 1960's. The two known heat treatment processes are as follows:

Heat Treatment A.

Solution treatment at 1700–1850° F. for a time commensurate with section size, then air cool;

Stabilization Treatment at 1550° F. for three hours, then air cool; and

Precipitation Treatment at 1325° F. for 8 hr, then furnace cool at 100° F./hr to 1150° F./8 hr, then air cool.

Heat Treatment B.

Solution Treatment at 1700–1850° F. for a time commensurate with section size, then air cool; and Precipitation Treatment at 1350° F. for 8 hr, then furnace cool at 100° F./hr to 1150° F./hr, air cool.

Heat Treatment A is typically recommended for optimum creep and rupture properties, while heat treatment B is typically recommended for applications requiring high tensile strength. A turbine rotor wheel or disk requires high tensile strength at low and intermediate temperatures (<700° F.) in some locations of the forging (e.g., near the bore and bolt holes) and optimum creep behavior in other parts (e.g., near the radially outer end). However, the OD of the part which is attached to the turbine blades, is at higher temperature during operation. If Heat Treatment A is used, the strength at the bore is not adequate, and if Heat Treatment B is used, there is not enough creep resistance at the high temperatures. Moreover, a surface flaw or crack can propagate rapidly under stress at temperatures above 900° F.

It was therefore generally thought desirable to use Heat Treatment A for the locations exposed to the higher temperature but at the same time have the tensile strength which Heat Treatment B can provide for the bore locations. No process exists, however, to develop different properties at different locations in the complex shape of a turbine rotor wheel or disk.

Prior U.S. patents of interest include U.S. Pat. No. 6,146,478; U.S. Pat. No. 5,846,353; U.S. Pat. No. 5,863,494; and U.S. Pat. No. 5,374,323. The '478 patent applies the INCO recommended Heat Treatment A with some modifications to large turbine disks. This heat treatment process will impart good rupture and crack growth resistance, but will have poor strength at low and intermediate temperatures. The '353 patent discloses modification of the composition for improved hot ductility at temperatures above 1300° F. The '494 patent modifies the process to achieve high strength at temperatures above 1300° F. The '323 patent describes a process of manufacturing a turbine disk using the Heat Treatment B but does not address the problem of creep and accelerated crack growth at temperatures above 900° F.

While the treatments described in certain of these patents (the '478, '353 and '494 patents) improve some properties at high temperatures, they do not also improve strength at low and intermediate temperatures.

SUMMARY OF INVENTION

This invention uses a relatively simple but controlled heat treatment process whereby a turbine rotor disk will develop the required properties at the required locations. This means that the outer diameter and the surface of the disk will have good creep and crack growth resistance, while the interior and bore will have high strength at temperatures below 750° F. The process can be implemented easily at facilities with standard industrial furnaces and does not require complicated fixtures. Furnace control and timing are critical but are of the kind available in most modern furnaces.

More specifically, this invention utilizes the turbine disk shape to tailor the heat treatment to achieve the desired results. For example, the geometry of a turbine disk is such that the outer diameter has a lower thickness than the bore area. As a result, after the initial solution treatment and cooling steps, the outer diameter and surface of the disk will remain at stabilization temperature for a longer period than the deep-seated locations near the bore. The disk is thereafter rapidly cooled from the stabilization temperature to room temperature, and before the disk has a chance to achieve a uniform temperature throughout.

In other words, the disk is held in the furnace for a specific time and, at the end of this time, the surface and outer diameter of the disk experience the temperature reached in the furnace for a longer period of time than the center (interior) and bore because of the section size differences and the slow conduction of heat through the part.

By controlling time at stabilization temperature, it is possible to have the outer diameter and surface exposed to 1550° F. for the right time to get good creep crack growth resistance and creep properties while the bore and inside surface of the part will be exposed to shorter times at this temperature and therefore have higher strength.

Accordingly, in one aspect, the present invention relates to method of heat treating a turbine rotor disk to obtain different radial properties at different locations in the rotor disk comprising: a) heating the rotor disk for a period of from 4 to 10 hours at a temperature of 1800° F.; b) cooling the rotor disk to a temperature of about 1550° F.; c) holding the rotor disk at about 1550° F. for a period of from about 2 to about 4 hours; d) cooling the rotor disk to room temperature; and e) precipitation aging the rotor disk by heating the rotor disk to temperature of 1325° F. for 8 hours, and f) cooling the rotor disk.

In another aspect, the invention relates to a method of method of heat treating a turbine rotor disk to obtain different radial properties at different locations in the rotor disk comprising: a) heating the rotor disk for a period of from 4 to 10 hours at a temperature of 1800° F.; b) cooling the rotor disk to a temperature of about 1550° F.; c) holding the rotor disk at about 1550° F. for a period of from about 2 to about 4 hours; d) cooling the rotor disk to room temperature; e) precipitation aging the rotor disk by heating the rotor disk to temperature of 1325° F. for 8 hours, and f) cooling the rotor disk; wherein step d) is carried out by cooling the rotor disk at a rate of 20°–40° F./min; and wherein step f) is carried out by furnace cooling the rotor disk at a rate of 100° F./hour to 1150° F., holding at 1150° F. for 8 hours and then air cooling the rotor disk to room temperature.

In another aspect, the invention relates to method of heat treating a turbine rotor disk to obtain different radial properties at different locations in the rotor disk comprising: a) heating the rotor disk for a period of 4 hours at a temperature of 1800° F.; b) cooling the rotor disk to a temperature of about 1550° F.; c) holding the rotor disk at about 1550° F. for a period of about 2 hours; d) cooling the rotor disk to room temperature at a rate of 20°–40° F./min; e) precipitation aging the rotor disk by heating the rotor disk to temperature of 1325° F. for 8 hours, and f) furnace cooling the rotor disk at a rate of 100° F./hour to 1150°, holding at 1150° F. for 8 hours and then air cooling the rotor disk to room temperature.

In still another aspect, the invention relates to a turbine rotor disk heat treated according to the processes disclosed herein.

The invention will now be described in more detail in connection with the drawings identified below.

BRIEF DESCRIPTION OF DRAWINGS

The Figure is a cross-section of a typical turbine rotor disk of the type that is amenable to the heat treatment of this invention.

DETAILED DESCRIPTION

With reference to the Figure, a turbine disk 10 is shown in cross-section, and illustrates the complex shape that requires specialized heat treatment. The shape varies from a relatively thick radially inner portion 12 that is radially adjacent the rotor bore, through an intermediate portion 14 of decreasing thickness, to a radially outer portion 16 that is generally thinner than portion 12 but with variations indicated at 18 and 20.

In arriving at the heat treatment process of this invention, the above described geometry is taken into account, recognizing that the outer portion 16 and surfaces thereof remain at stabilization temperature for a longer period than the inner portion 12 near the bore (not shown). The disk may be rapidly cooled from the stabilization temperature before the disk has a chance to achieve a uniform temperature throughout. In other words, after stabilization, the outer portion experiences this temperature for a longer period than the inner portion because of cross-sectional size deficiencies and slow conduction of heat through the disk.

Testing and experimentation have determined that: 1) Cooling rates after solution treatment need to be slow (1–5 Deg. F./min) for good strength.

2) cooling rates after stabilization treatment need to be high (15–30 Deg. F./min) for good strength.

3) Increased stabilization time reduces low temperature strength (limits being determined); and 4) Increased stabilization time improves crack growth resistance and creep properties (limits being determined).

We have further determined that items 3 and 4 above provide a basis for optimizing the heat treatment for a large disk (for example, an Alloy 706 turbine disk. The objective is to get the surface and outer diameter to be at the stabilization temperature for no more than three (3) hours, and the inner diameter portion at that temperature for less than that time.

Based on the above, it has been determined that one advantageous heat treatment for a rotor disk is as follows: a) solution treatment of the rotor disk at 1800° F. for a period from 4 to 10 hours, and preferably about 4 hours; b) cooling the rotor disk at a rate of from 1° to 5° F./min., and preferably about 3° F./min. down to 1550° F.±25° F.; c) stabilizing the rotor disk at 1550° F.±25° F. for 2 to 4 hours, and preferably about 2 hours; d) cooling the rotor disk at a rate of from 20°–40° F./min. and preferably about 25° F./min. to room temperature; e) precipitation aging of the rotor disk by heating the rotor disk to 1325° F. and holding for 8 hours; and f) furnace cooling the rotor disk at a rate of 100° F./hour to 1150° F., holding at 1150° F. for 8 hours and then air cooling to room temperature.

By so controlling the treatment of the rotor disk, it is possible to have the outer diameter and surface of the disk exposed to 1550° F. for sufficient time to obtain good creep crack growth resistance and creep properties, while the bore and inside surface of the disk will be exposed at the same temperature for shorter times and thus have higher strength in this region.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A method of heat treating a turbine rotor disk varying in cross sectional shape from a relatively thick radially inner portion to a relatively thinner radially outer portion to obtain different radial properties at different radial locations in the rotor disk comprising:

a) heating the rotor disk for a period of from 4 to 10 hours at a temperature of 1800° F.;

b) cooling the rotor disk to a temperature of about 1550° F. at a rate of from 1 to 5° F./min;

c) holding the rotor disk at a stabilization temperature of about 1550° F. for a period of from about 2 to about 4 hours such that radially outer portions of the disk are exposed to said stabilization temperature for longer periods of time than radially inner portions of the rotor disk;

d) cooling the rotor disk to room temperature at a rate of 20°–40° F./min;

e) precipitation aging the rotor disk by heating the rotor disk to temperature of 1325° F. for 8 hours, and f) cooling the rotor disk;

wherein creep and creep crack growth resistance are enhanced at radially outer locations of the rotor disk and strength is enhanced at radially inner locations of the rotor disk.

2. The method of claim 1 wherein step a) is carried out for 4 hours.

3. The method of claim 1 wherein step c) is carried out for 2 hours.

4. The method of claim 1 wherein step d) is carried out by cooling the rotor disk at a rate of about 25° F./min.

5. The method of claim 1 wherein step f) is carried out by furnace cooling the rotor disk at a rate of 100° F./hour to 1150° F., holding it at 1150° F. for 8 hours and then air cooling the rotor disk to room temperature.

* * * * *